United States Patent [19]

Bok

[11] 4,318,626

[45] Mar. 9, 1982

[54] PEN WITH AN IMPROVED INK INJECTION SYSTEM

[76] Inventor: Edward Bok, Burgemeester Amersfoordt Laan 82, Badhoevedorp N.H., Netherlands

[21] Appl. No.: 2,095

[22] Filed: Jan. 9, 1979

[30] Foreign Application Priority Data

Nov. 15, 1979 [NL] Netherlands ..... 7.711.065

[51] Int. Cl.[3] ..... B43K 5/10

[52] U.S. Cl. ..... 401/151

[58] Field of Search ..... 401/151, 135, 133, 223, 401/198, 199

[56] References Cited

U.S. PATENT DOCUMENTS

| | | | |
|---|---|---|---|
| 3,065,732 | 11/1962 | Fejes | 401/151 |
| 3,083,690 | 4/1963 | Marban | 401/151 X |
| 3,246,632 | 4/1966 | Marban | 401/151 |
| 3,819,284 | 6/1974 | Kreuzer | 401/151 |

*Primary Examiner*—John D. Yasko

*Attorney, Agent, or Firm*—Cesari and McKenna

[57] ABSTRACT

An ink pen has master and slave ink reservoirs and an ink lock communicating with one or more capillary buffer channels inside the master reservoir and preventing air flow to the slave reservoir.

14 Claims, 15 Drawing Figures

PEN WITH AN IMPROVED INK INJECTION SYSTEM

BACKGROUND OF THE INVENTION

In the Dutch Patent application No. 7,711,065, pen design features are mentioned whereby a slave ink reservoir is being used, as well as an ink injection system for the transport of ink from this reservoir to a master ink reservoir and an ink lock which prevents the build-up of a large accumulation of slave ink in the master ink reservoir.

The disadvantage of this pen design is that the ink lock cannot function effectively with an automatic or semiautomatic ink injection system to feed the master reservoir.

SUMMARY OF THE INVENTION

To obtain a good functioning pen, a manual ink injection system has to be used whereby the pen has to be held vertically during the transfer of ink and with the tip pointed downwards.

In the present invention, the ink lock feature is part of the ink transfer system.

This ink lock design consists mainly of at least one relatively narrow channel through which venting air can flow to the air passage of the ink transfer tube, which is positioned between this ink lock and the slave ink reservoir.

The ink lock feature is connected with at least one capillary ink buffer channel inside the Master ink reservoir. This channel in turn is connected with the pen tip by capillary action.

Since the ink buffer channels are running across inside the master ink reservoir, and are the same or larger dimensioned as the ink lock channel, the ink lock channels are always filled with ink if the ink buffer channels are filled beyond a certain balanced volume ink, which causes an ink lock in the channel, thus preventing air to flow to the slave ink reservoir.

DESCRIPTION OF THE PREFERRED EMBODIMENTS

Figure 1:
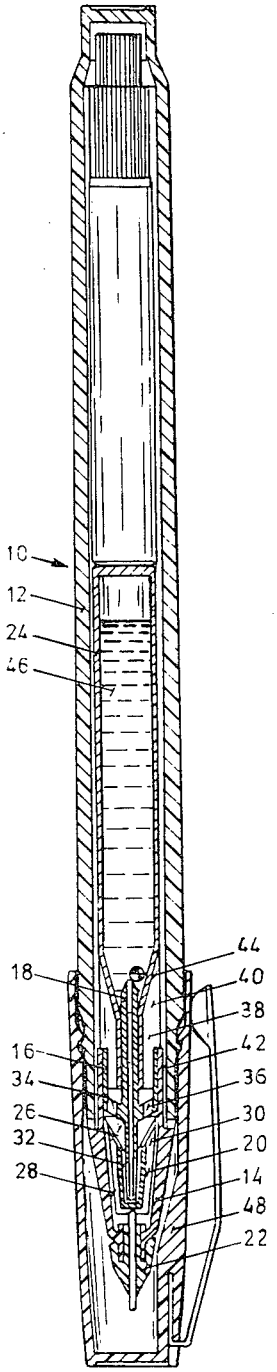
FIG. 1 is a vertical sectional view of the pen of the present invention.
Figure 3:
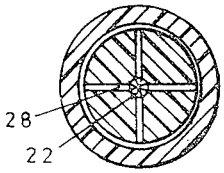
FIG. 3 is a cross-sectional view of the pen taken along line 3—3 of FIG. 2.

As illustrated in FIG. 1, the pen of the present invention is designated generally by the reference number 10 and consists of a holder 12, a pen nib 14, functioning as contained ink reservoir, an ink injection tube 18 as part of the pen nib top 16, an ink buffer unit 20, a pen tip 22, a disposable ink cartridge 24, and a protective cap 26.

The tube 18 extends down into the ink buffer unit 20, whereby the combination of capillary ink channels 26 and 28 connect this lower tube end with the ink buffer channels 30 and the capillary ink passage of the tip 22 by means of capillary action.

Furthermore, this lower tube end is connected with the air compartment 34 in the pen nib via the vent passage 32.

This air compartment is connected with the outer atmosphere via the vent passages 36 in the nib top 16, vent channels 38 in the leak-ink collector 40, and outer vent passage 42 between holder 12 and nib 14. The ink 46 is automatically supplied from the ink cartridge 24 and via the capillary ink supply channel of the injection tube 18 into the contained ink reservoir 14.

The vent passage 32 around the injection tube 18 and the ink buffer channels 30 of the ink buffer unit 20 have approximately the same ink containing characteristics. Thereby the vent passage is able to contain ink as an ink lock and both vent passage and ink buffer channels are able to transfer ink to the capillary ink channels 26 and 28, if ink is withdrawn from such channels 26 and 28 via the pen tip.

Ink collector 40 acts as a safeguard against expulsion of ink by a plurality of capillary ink collecting channels 44, whereby particles of ink are collected, that are expelled from ink buffer channels 30 and passage 32.

The sealing of the pen interior is established by the protective cap 48 via the lateral sliding seal 50.

Figure 2:
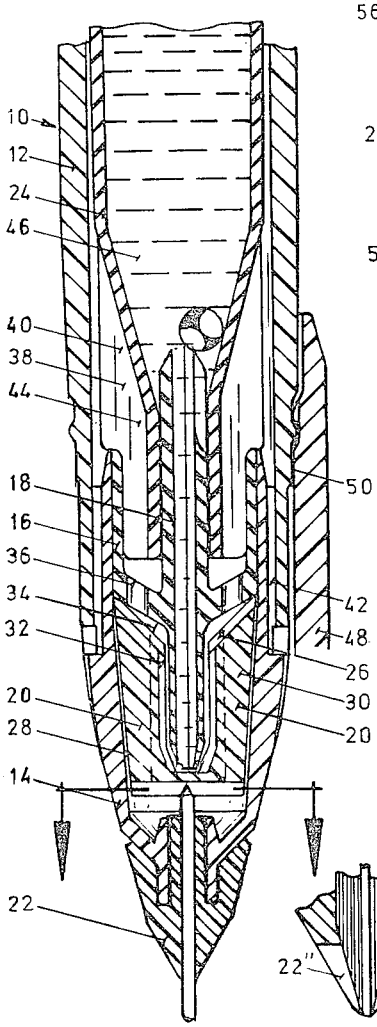
FIG. 2 is an enlarged vertical sectional view of the lower section of the pen, as shown in FIG. 1.
Figure 4:
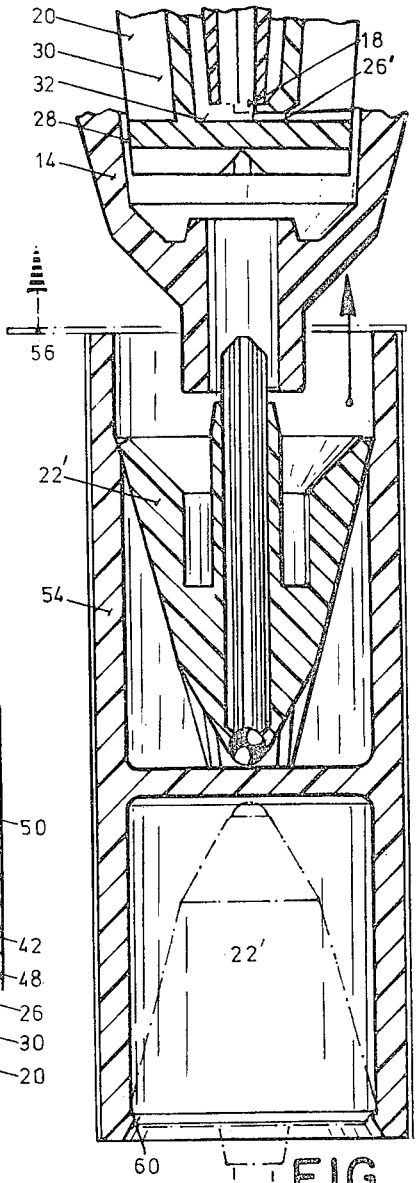
FIG. 4 shows the positioning of a new ball tip to the lower end of the pen illustrated in FIG. 1, which pen is provided with an adapted ink buffer unit.
Figure 5:
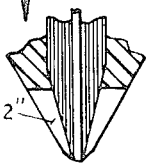
FIG. 5 shows the pen illustrated in FIG. 1, whereby the nib is provided with a nylon pen tip.

The exchangeable pen tip can be of the following types:

1. A fibrous tip, see FIGS. 1 and 2.
2. A ball tip, see FIG. 4.
3. A slitted nylon tip, see FIG. 5.

Figure 6:
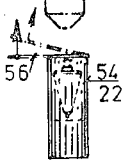
FIG. 6 shows an enclosure for a new tip whereby this enclosure also contains a means to remove the old tip.
Figure 9:
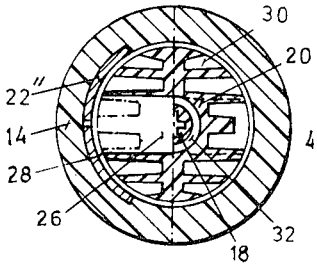
FIGS. 9–11 are sectional views along the lines 9—9, 10—10, and 11—11, respectively, of FIG. 8.
Figure 10:
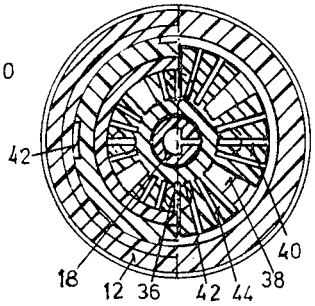

A simple change of the pen tip 22 is accomplished by changing the container 54, see FIG. 6. The new pen tip 22, which is saturated with ink or ink thinner, is air tight enclosed in this container by means of the puncturable plastic cover 56.

The old pen tip can be removed from the pen nib 14 after its notches of the container 54 are clicked beyond the rim 60 of this tip.

Figure 7:
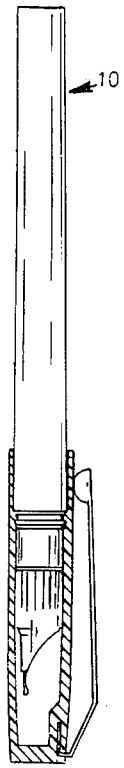
FIG. 7 is an illustration of the pen of FIG. 1 fitted with a split-nib type of tip.
Figure 8:
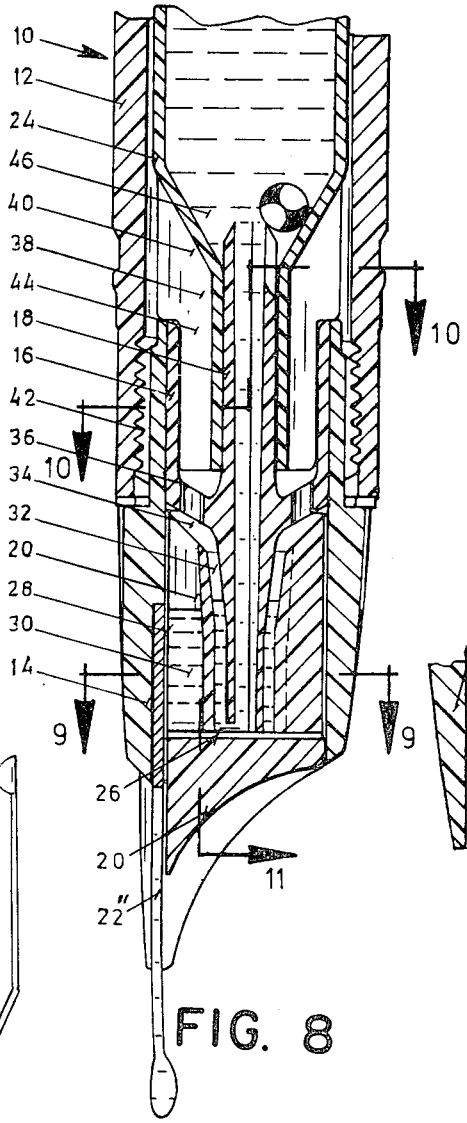
FIG. 8 is an enlarged vertical sectional view of the lower portion of the pen of FIG. 7.
Figure 11:
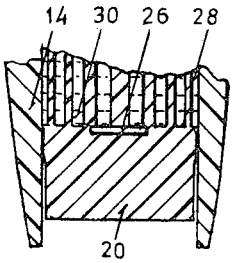
Figure 12:
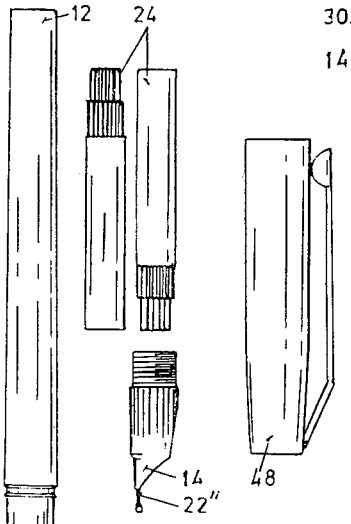
FIG. 12 is a view of the separate functional components of the pen of FIG. 7.
Figure 13:
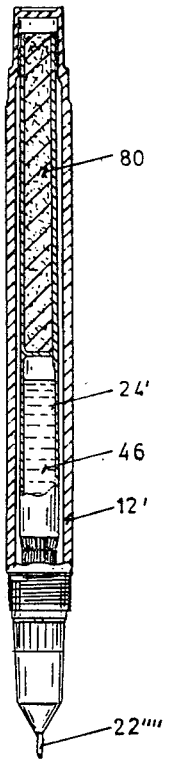
FIG. 13 is a vertical view, partly in section, of a pen of the present invention fitted with a stylographic tip.
Figure 14:
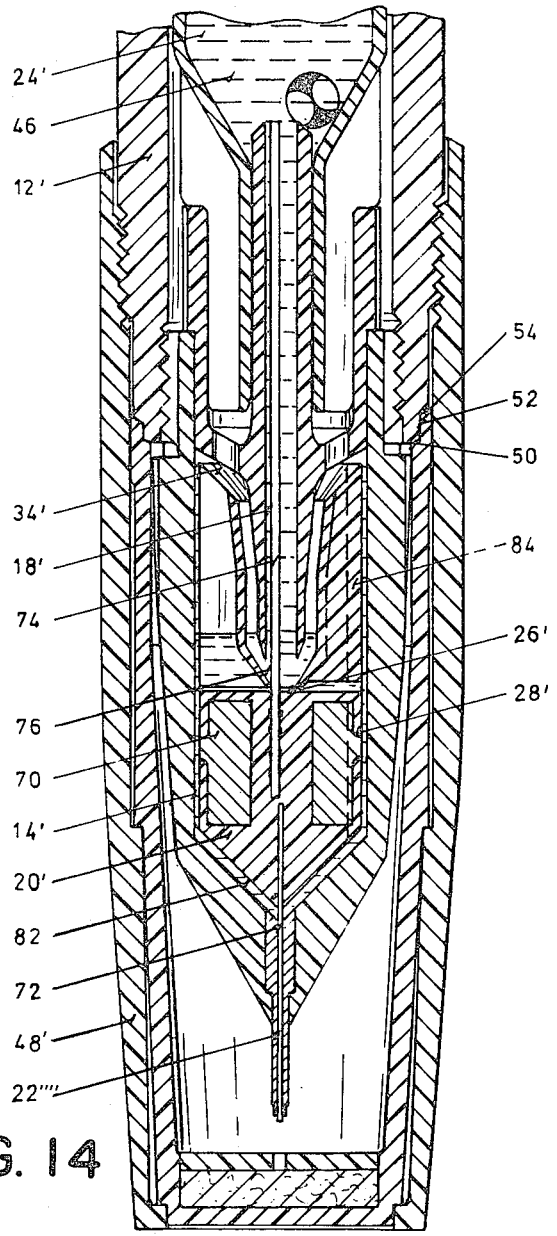
FIG. 14 is an enlarged vertical sectional view of the lower end of the pen, illustrated in FIG. 13.

A securing of the new pen tip is accomplished by the following:

1. The sharp edges 62 of the nib locally punctures the plastic cover 56, and 2. A complete opening of this punctured seal is obtained by means of the lower end of the nib, whereby remnants of this cover are urged against the inner wall of the container, see FIG. 4. The ink buffer unit 20, in FIGS. 7 and 8, also contains the cleaning wire-weight 70 and cleaning wire 72, which extends through the tip 22. Furthermore, it is provided with an upward extending cleaning wire 74, which extends through the injection tube 18, enabling a perfect transport of ink 46 through this tube by means of the changes of the pen position during pen-use with longitudinal displacements of the ink buffer unit and consequently of this wire 74.

The sealing of the pen interior by means of the protective cap 48 is perfect, which is due to the combination of the 3 seals, 50, 52 and 54.

A tampon, containing vaporizable ink thinner, can be located in the pen holder 12 on top of the ink cartridge. Its function is to prevent the pen interior from drying out and the vaporized thinner acts as a vapor-lock between the incoming venting air and the contained ink reservoir.

Both cartridge and tampon can be contained in one disposable unit.

Other embodiments of the illustrated pens such as pens with slitted metal tips, are possible within the scope of the invention.

The embodiments of theinvention in which an exclusive property or privilege is claimed are defined as follows:

1. A pen comprising:

a first ink reservoir, a second ink reservoir beneath said first ink reservoir, containing capillary ink buffer channels in capillary communication with each other, an ink injection tube, extending downward from said first ink reservoir to said second ink reservoir, a pen tip is capillary communication with said ink buffer channels, venting means, extending upward from a position near the bottom of said second ink reservoir to the outer atmosphere, and an ink control means in between said ink injection tube and said ink buffer channels.

2. A pen as in claim 1, wherein said ink control means is at least one communication channel for ink supply and venting and dimensioned such a way that ink can be capillary contained therein with the creation of an ink lock, preventing a downward flow of air to pass through.

3. A pen as in claim 2, wherein said ink buffer channels have approximately the same ink containing and air flow characteristics as said communication channel.

4. A pen as in claim 3, wherein said communication channel extends in lateral direction from said centrally positioned ink injection tube.

5. A pen as in claim 4, wherein a vent compartment is located in the pen nib as second ink reservoir above said ink buffer channels, and said vent compartment is capillary connected with the entrance of said communication channel via at least one downwardly extending capillary ink- and vent channel.

6. A pen as in claim 5, wherein at least part of said ink buffer channels extend in longitudinal direction and the combination of length and width thereof is such that if such channel is ink filled, said ink remains retained therein during moderate shakings of said pen.

7. A pen as in claim 5, wherein a separation wall is located, which extends in a lateral direction and whereby said ink injection tube is part of, which is extending upwardly beyond said wall for the leak-free securing thereto of an ink cartridge as the first ink reservoir, the compartment above said wall extending downwardly aside said nib in communication with the outer atmosphere via at least one opening in said wall in communication with said vent compartment, above said ink buffer channels and via a vent channel.

8. A pen as in claim 7, wherein in the pen holder a leak-ink collector as container for said ink cartridge in the outer lower section of said ink cartridge is located for the collection of leak-ink, expelled from said pen nib.

9. A pen as in claim 5, wherein said ink injection tube, a longitudinally extending capillary ink injection channel and a wider vent channel are located.

10. A pen as in claim 9, wherein said ink buffer channels are at least partly located in an enclosure for a wire weight, said wire weight displaceably enclosed in said pen nib in at least longitudinally direction, such that said ink control means remains effective, to the lower end of said weight enclosure a cleaning wire is secured, extending downwardly in an ink passage of aid pen tip and to the top of said weight enclosure an ink transport wire is secured, extending upwardly in said ink injection tube to at least near the top of said tube.

11. A pen as in claim 10, wherein said ink transport wire is not centrally positioned in said weight enclosure with in addition a capillary ink transport cnannel and a capillary vent channel in said ink injection tube.

12. A pen as in claim 11, wherein a disposable tampon cartridge is positioned, containing vaporizable ink thinner in said pen holder.

13. A pen as in claim 12, wherein said tampon is part of said ink cartridge.

14. A pen as in claim 13, whereby a moisture indicator is positioned in the sidewall of said pen.

* * * * *